United States Patent [19]

Robotham et al.

[11] 4,006,334

[45] Feb. 1, 1977

[54] SAFETY SWITCH FOR POWER TOOL

[75] Inventors: William Frederick Robotham, St. Charles; Larry D. Annis, Elgin, both of Ill.

[73] Assignee: McGraw-Edison Company, Elgin, Ill.

[22] Filed: Mar. 17, 1975

[21] Appl. No.: 558,634

[52] U.S. Cl. ..... 200/157; 200/61.85; 200/321

[51] Int. Cl.$^2$ ..... H01H 3/20

[58] Field of Search ..... 200/318–328, 200/157, 61.85

[56] References Cited

UNITED STATES PATENTS

| | | | |
|---|---|---|---|
| 3,308,535 | 3/1967 | Freeman et al. | 200/157 |
| 3,766,352 | 10/1973 | Bigley et al. | 200/157 |

*Primary Examiner*—Robert K. Schaefer
*Assistant Examiner*—Morris Ginsburg
*Attorney, Agent, or Firm*—Charles F. Lind

[57] ABSTRACT

This invention teaches an on/off switch design that can be used in electric power tools, where the power is normally off and further cannot be shifted on unless a switch actuating element is first manipulated through two right angle motions according to a predetermined sequence. The subject device has a normally off on/off switch and a switch actuating element that is supported to move against the switch to shift the same on. The actuating element carries a latch that normally holds it in the switch off position. The latch must first be moved laterally against the force of a biasing spring and held there to release the actuating element, and only then can the actuating element be moved at right angle to the latch releasing movement and then depressed, effective to switch the on/off switch on.

4 Claims, 8 Drawing Figures

FIG. 1
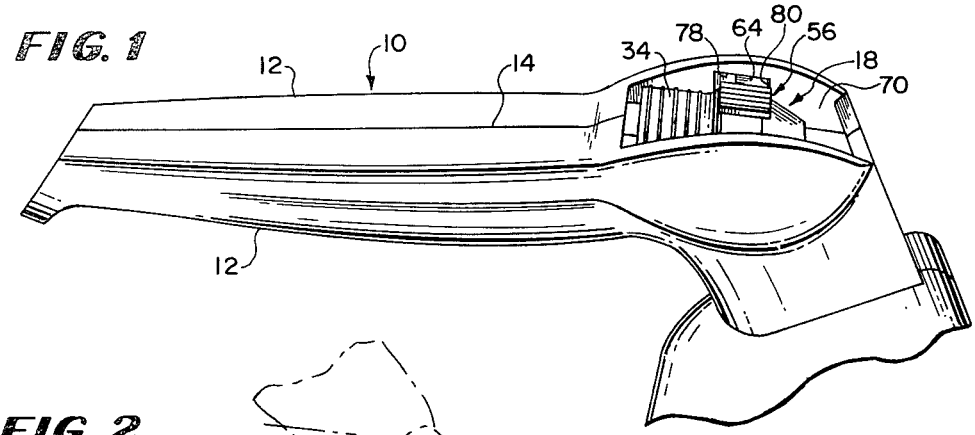
FIG. 2
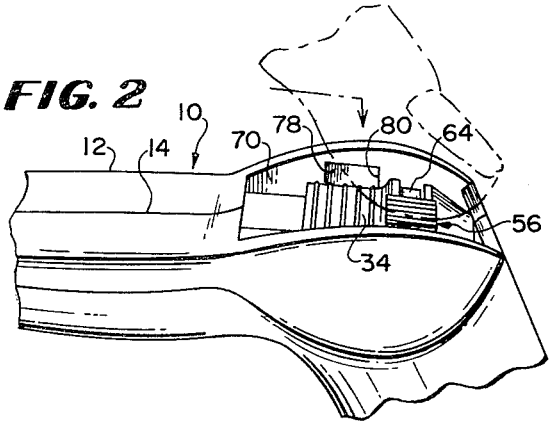
FIG 3
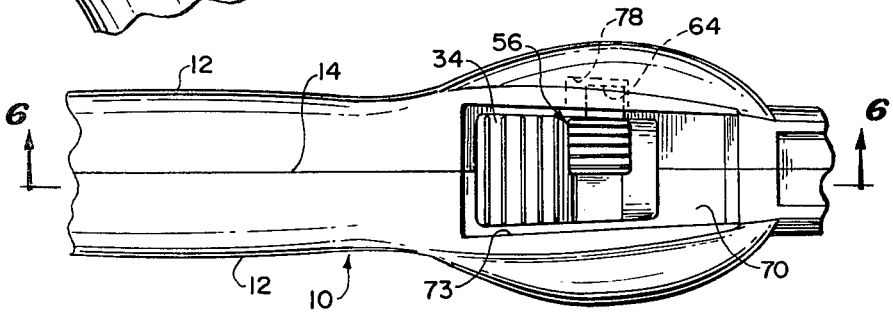
FIG. 4
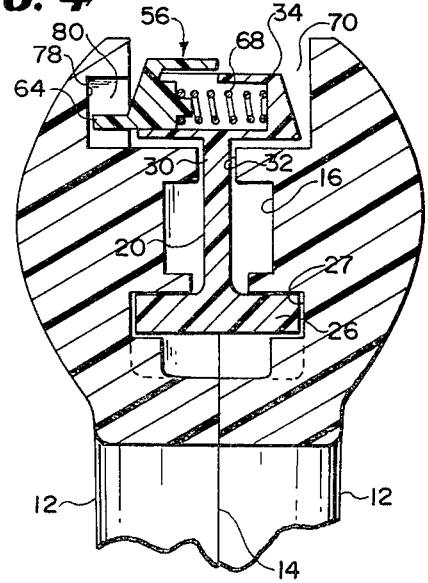
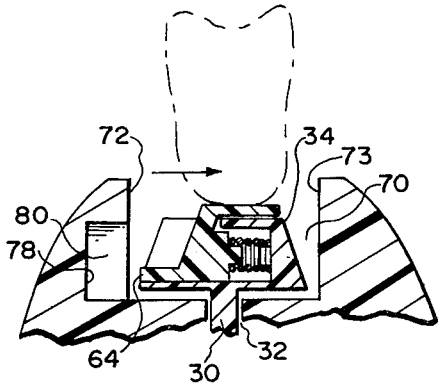
FIG. 5

SAFETY SWITCH FOR POWER TOOL

The Underwriters' Laboratories, Inc., by recent enactment, necessitates that certain portable electric power tools including power saws, hedge cutters, and many other potentially dangerous high-speed cutting tools, have an on/off switch which would be normally held in the off position and further could not be shifted from this off position to the on position unless a switch actuating button was first manipulated through two right angle motions according to a predetermined sequence. This was to preclude the accidental triggering of the switch occasioned most commonly in the past upon dropping the tool or having something drop on or brush against the tool, and/or by merely gripping the tool to carry same but at or over the on/off switch button sufficient to shift it. The switch was also to return automatically to the off position after the button element has been released.

This invention relates to an economical but reliable safety switch design which satisfies these requirements. The design actually requires an actuating movement in three different directions all according to a proper sequence in order to manipulate an on/off switch from the off position to the on position.

Specifically, an on/off switch is actuated by, and only by, a button element, and to shift the switch from the off condition to the on condition a latch holding the button element secure must first be moved laterally against the force of a biasing spring and held there to release the button element, and then the button element must be moved forwardly at right angle to the latch releasing movement a a minimum distance and then depressed downwardly, and only then will the on/off switch be shifted on for power activation of the tool.

Specific advantages of this invention will be more fully understood and appreciated after reviewing the following specification, including as a part thereof the accompanying drawings, wherein:

FIG. 1 is a perspective view showing a typical tool handle having a preferred embodiment of the subject safety switch device disposed therein;

FIG. 2 is a view similar to FIG. 1, except showing the device in the actuated switch on position;

FIG. 3 is a top view of the switch device illustrated in FIG. 1;

FIG. 4 is a sectional view, as seen generally from lines 4—4 in FIG. 6, of the switch device mechanical interlock shown in the switch off position;

FIG. 5 is a view similar to FIG. 4, except showing the interlock in the released position;

Figure 6:
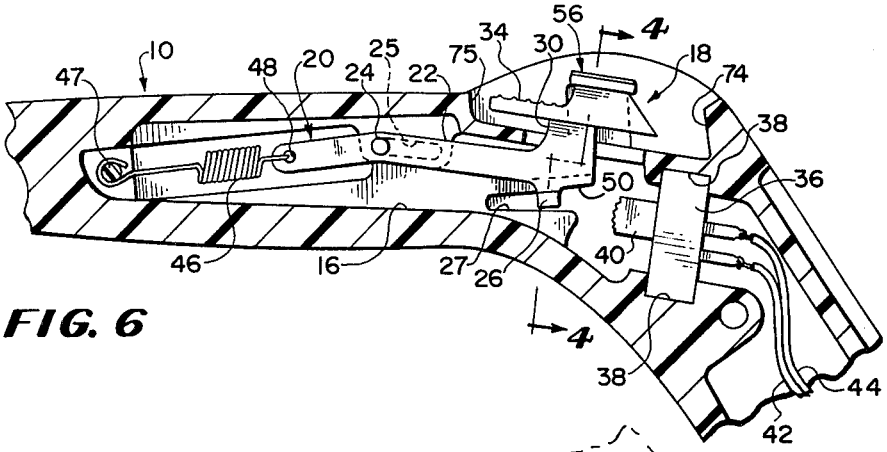
FIG. 6 is a sectional view, as seen generally from line 6—6 in FIG. 3, of the switch device shown in its off position.

The invention is illustrated in a handle 10 of the type having two half-pieces 12 that butt together along parallel parting lines 14 to form an elongated hollow housing defining enclosure 16 therein. The handle has an externally exposed switch actuating device 18 located to be operated by the thumb of the user, and this invention provides that specific actuating movement is required in order to actuate the tool.

The device 18 includes a slide element 20 located within the enclosure 16, and the slide element 20 is guided to move along a prescribed path generally in line with the handle. Specifically, the slide element has an elongated body portion 22 with spaced pairs 24 and 26 respectively, of opposed pins that are adapted to be received within cooperating recesses or track means 25 and 27 formed in the opposing half-pieces of the housing. A neck 30 projects laterally from the body portion 22 and through an opening 32 in the housing to support a button portion 34 exposed for manual manipulation, while the remainder of the slide is located within the enclosure 16 and thus isolated from the user.

An electric switch 36 is also located within the enclosure 16, shown as supported within opposed recesses 38 in the half-pieces of the housing. The switch can be of typical construction having separable contact means (not shown) which are normally opened and which are closed by movement of an actuator 40 operable to complete an electric connection between conductors 42 and 44 in the closed condition only. The actuator 60 moves along a given path between its off position indicated of the off condition of the switch (shown in FIG. 6) and its on position indicative of the on condition of the switch (shown in FIG. 7), and this direction of movement is generally in a direction normal to elongation of the handle. The actuator 40 normally is maintained in its off position by a spring (not shown) located in the switch construction itself.

A spring 46 connected to housing pin 47 and fitted within opening 48 of the slide 20 normally tends to move the slide to its retracted position furthest spaced from the switch 36. The slide 20 at this point is spaced from the switch 36 so that normally open switch is in the power off condition. Forward movement of the exposed button 34 shifts the slide element from its retracted position to an intermediate position where a shoulder 50 formed on the body portion 22 of the slide overlaps the switch actuator 40 and is in close proximity with the actuator. Also at this position, the guide channels 27 for pins 26 close to the switch curves at sharp angles from the normal path and this allows the pins 26 to move unrestricted generally at right angles to the initial travel along the guide recesses 27 and allows downward depression of the button. This downward depression of the button is at right angles from the initial movement of the button from its retracted position to its intermediate position, and further the downward button depression causes the switch to be shifted from its off position to its on position (shown in FIG. 7).

The subject switch device further provides for a latch 56 which is carried on the button portion 34 of the slide 20 and is thus exposed for manual manipulation. The latch 56 has a generally I-shaped configuration having a web 60, an upper flange 62, and a lower flange 64, and fits within guide or channel 58 on the button element. The upper flange 62 is exposed above the top surface of the button and is provided with knurls 66 to assist in gripping of the same, allowing lateral movement. A coil compression spring 68 confined within the channel 58 normally biases the latch to an extended position (shown in FIG. 4) although the latch can be moved against the spring to a retracted or release position (shown in FIG. 5).

The actuating button 34 is further located within a recess 70 defined by the base wall 71, opposed side walls 72 and 73, and front and rear walls 74 and 74 respectively. These walls extend up beyond the upper portion of the button to eliminate any possibility of a straight object from sliding along the handle and shifting the switch, since the switch button would not in fact even be engaged by the straight object.

Figure 7:
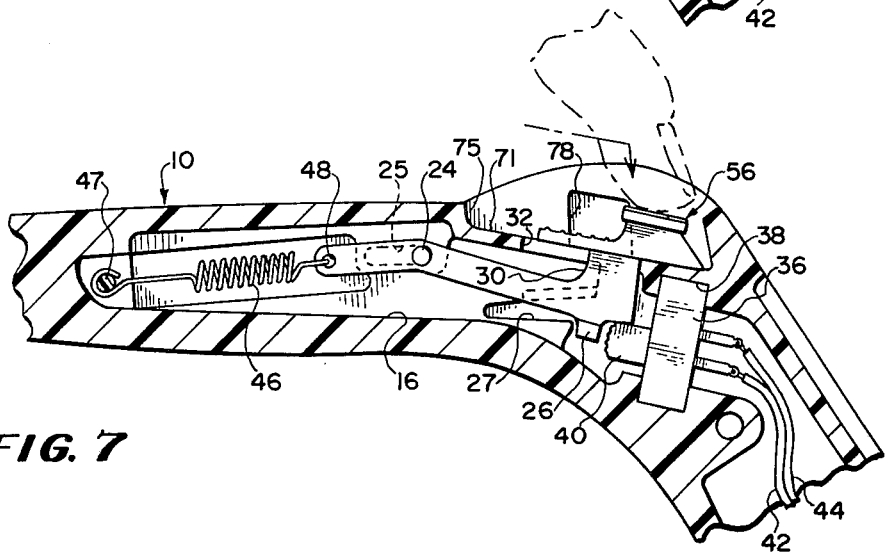
FIG. 7 is a view similar to FIG. 6, except showing the switch device in the switch on position.
Figure 8:
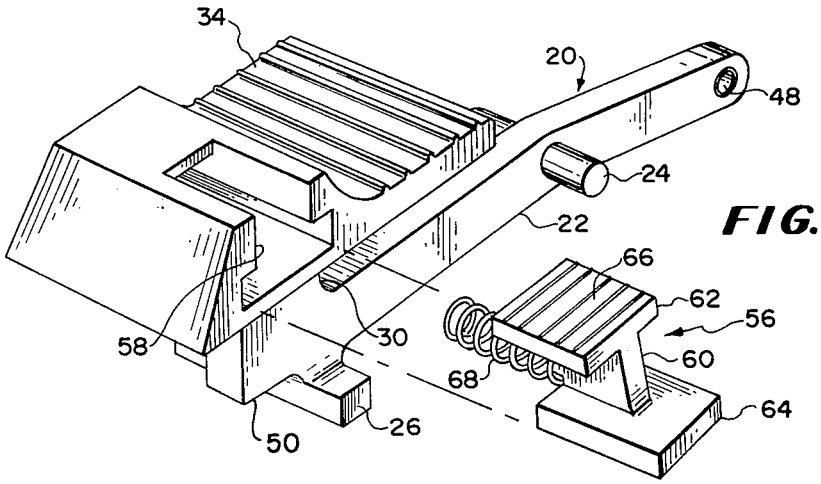
FIG. 8 is a perspective view of the moving components used in the acutating switch button of the switch device illustrated in the previous figures.

The one side wall 72 is provided with a recess 78 which serves to receive the extended lower flange 64 of the latch when the latch is in its extended normal position, and housing shoulder 80 defining one side of the recess 78 is engaged by the protruding lower flange of the latch and thereby does not allow movement of the button from its retracted position (shown in FIG. 7). This thus requires the latch to be moved in a lateral direction as seen in FIG. 5 to remove the lower flange 64 from interference with the shoulder. The button can be then slid forwardly along its path from its retracted position to its intermediate position and then depressed in a downward direction generally at right angles from its initial movement to shift the switch actuator from its off position (shown in FIG. 6) to its on position (shown in FIG. 7).

As thus noted, the switch cannot be shifted from its off position to the on position without the deliberate movement along given predetermined sequences of a switch actuator including initially the lateral movement of the latch 56 to release the latch and then followed successively by a forward movement in a direction generally at a right angle from the latch release movement and finally followed by a downward depressing movement again generally at right angles from the forward movement. The switch further automatically returns to its off position upon release of the button.

What is claimed is:

1. A safety switch device for use in a portable electric tool housing defining a hollow enclosure with an opening thereto, the combination comprising a slide element received in the housing enclosure and being exposed through the housing opening, a latch carried by the slide element for exposure outside the enclosure and for manual manipulation and means supporting the latch for movement relative to the slide element along a first direction between two operative positions, means to guide the slide element for movement relative to the housing in a second direction generally at right angles to the first mentioned direction between a retracted position and an intermediate position and then to guide the slide element for movement relative to the housing in a third direction generally normal to both the first and second mentioned directions to a depressed position, and on/off electrical switch and means in the housing for holding the switch within the enclosure, said switch having an actuator which in one position is indicative of a power off condition and in a second position is indicative of a power on condition and wherein the actuator is movable between the two positions, the slide element having a shoulder that is closely disposed to and overlaps the switch actuator when the slide element is in the intermediate position thereof and that engages and moves the switch actuator from the off position to the on position upon movement of the slide element to the depressed position, a spring normally biasing the slide element to the retracted position, a spring normally biasing the latch to one of said operative positions and said housing having a recess suited for receiving said latch in the one operative position when said slide element is in the retracted position, and the housing having a shoulder against which the latch in the one operative position abuts when the slide element is in the retracted position operable to preclude slide element movement therefrom without first manually shifting the latch from the one operative position to its other operative position.

2. A safety switch device according to claim 1, wherein the means to guide the slide element relative to the housing include spaced pairs of opposed pins projecting from the slide element and adapted to fit within cooperating channel or recess means formed in the housing.

3. A safety switch device according to claim 2, wherein the housing is of the type having two half-pieces mating along generally parallel parting lines, and wherein the channel or recess means formed in the housing are formed in the housing half-pieces open toward the parting lines thereof.

4. A safety switch device according to claim 1, wherein said housing includes walls located adjacent and surrounding the housing opening and disposed to generally surround the exposed latch, and wherein the walls extend upwardly beyond the top profile of the latch to preclude contact thereagainst of a straight element spanning the walls.

* * * * *